United States Patent [19]

Evenson

[11] Patent Number: 4,775,128

[45] Date of Patent: Oct. 4, 1988

[54] COPY HOLDER

[75] Inventor: Mel Evenson, San Pedro, Calif.

[73] Assignee: Eldon Industries, Inc., Inglewood, Calif.

[21] Appl. No.: 54,368

[22] Filed: May 26, 1987

[51] Int. Cl.[4] ..... A47B 97/04

[52] U.S. Cl. ..... 248/448; 248/452

[58] Field of Search ..... 248/448, 449, 452, 453, 248/456, 454, 455, 408, 409, 474, 359; 281/45, 46; 108/6, 9

[56] References Cited

U.S. PATENT DOCUMENTS

| | | | |
|---|---|---|---|
| 462,467 | 11/1891 | Brown | 248/452 |
| 1,888,773 | 11/1932 | Ruelland | 248/452 |
| 1,947,053 | 2/1934 | Mason | 248/454 X |
| 2,014,176 | 9/1935 | Henderson | 248/456 |
| 2,900,153 | 8/1959 | Lazur | 248/408 X |
| 3,952,987 | 4/1976 | Bevington | 248/408 |
| 4,044,980 | 8/1977 | Cummins | 248/456 X |
| 4,436,271 | 3/1984 | Manso | 248/452 X |
| 4,603,883 | 8/1986 | Barbieri | 248/452 X |

*Primary Examiner*—J. Franklin Foss

*Attorney, Agent, or Firm*—Edward D. O'Brian

[57] ABSTRACT

A copy holder which is useful in holding items such as comparatively thick books can be constructed so that holdfasts capable of engaging whatever is held in the copy holder are movably mounted in openings in the copy holder. When so held these holdfasts are engaged by a conventional type spring loaded clamping member on the copy holder so that they are secured against movement as a result of such engagement.

4 Claims, 2 Drawing Sheets

COPY HOLDER

BACKGROUND OF THE INVENTION

The invention set forth in this application pertains to new and improved copy holders.

As used in this specification the term or expression "copy holder" designates a structure which is designed to be used or which is intended to be used in holding "copy" so that such copy can be visually inspected. The term "copy" as used in the preceding definition is intended to designate virtually anything which can be visually inspected. Copy holders are commonly used in offices and the like so as to hold or support one or more documents so that they can be visually inspected as they are copied on a typewriter or into a computer.

Although it is possible to construct copy holders in many different ways it is believed that the vast majority of these devices are constrcted so as to include a vertically oriented support member having a flat or generally flat front surface sloped so as to physically support a document such as a sheet of paper, a print or the like and so as to include a clamping or holding member located on the support member which is capable of holding such a document so that the document can be easily replaced after it has been inspected. Usually the clamping member is spring biased and is located adjacent to the top of the support surface. Frequently a support ledge or shelf will be positioned on the lower edge of the support member as a support for an in item held by a copy holder of the type indicated.

Copy holders constructed as indicated in the preceding discussion are considered to be highly utilitarian. However, it is considered that they have not been as utilitarian as one might reasonably desire because of the fact that they cannot be satisfactorilty used to hold a comparatively thick book or similar item open to a desired page. This is primarily the result of the fact the normally the holding capacity of the clamping member as described is rather limited.

Also it is considered that on occasion complications have been encountered when it has been desired to use known copy holders constructed as noted with items such as documents which are slightly longer than the normal space between the clamping member and the bottom lip of the support member. This type of problem can be encountered when it is desired to use a copy holder designed to be used with paper of a specific size-such as what is referred to in the US as "letter sized" paper-with paper of another size-such as A-4 sized paper. These two sizes of paper are so closely related that it is desirable to be able to supply a single copy holder which can be satisfactorily used with each.

BRIEF SUMMARY OF THE INVENTION

The invention is intended to improve upon known copy holders as described in the preceding by constructing them so that they can not only be used in holding documents consisting of one or more sheets of paper but also so that they can be satisfactorily used in holding books, especially comparatively think books, so that such books are open to any desired page. The invention is also intended to improve upon known copy holders by constructing them in such a manner that a copy holder dimensioned so as to be of primary utility with paper or the like of a specific size can be satisfactorily used with paper of a closely related, but somewhat greater size.

Further, the invention is intended to provide copy holders or stands as noted which can be easily and conveniently manufactured at a comparatively nominal cost. It is also intended to provide copy holders which are comparatively easy to use or employ and which may be satisfactorily used over prolonged periods with little or no maintenance. An objective to the invention is also to provide copy holders which are constructed so as to as have an appearance such as to tend to promote their commercial acceptance.

In accordance with this invention these various objectives are achieved by providing a copy holder having a vertically oriented support member containing a front surface which is adapted to hold an item so that it can be visually inspected and having a clamping member which is movable relative to the top of said surface so as to engage such an item so as to hold an item against movement in which the improvement comprises:

said support member including an opening extending there through, said opening being located adjacent to and beneath said clamping member , a holdfast having an elongated leg and a head, said leg being shaped so that said leg can be inserted within and moved within said opening so that said head is spaced at various distances from said surface, said clamping member and said holdfast being shaped and located so that said clamping member engages said holdfast when said leg is inserted within said opening so as to secure said holdfast against movement.

As a result of such a construction a copy holder of the present invention can be used in a conventional manner with comparatively thin documents such as a single sheet of paper of a thin brochure but can also be used with a comparatively thick item such as a book so as to hold such an item in an open configuration through the use of the holdfast. With the noted structure the hold fast is held against movement - when it is used - by the usual clamping member forming a part of the copy holder.

In a preferred construction in accordance with this invention the clamping member is located on a small plate which in turn is slidable mounted on the support member so that it can be moved from a normal position on the support member to extend a short distance from the remainder of the support member. This enables the copy holder to be used with items which are somewhat to large to be accommodated directly upon the support member. Such a plate can be used when there is no intent to use a holdfast as noted in the preceding discussion.

BRIEF DESCRIPTION OF THE DRAWINGS

Because of the nature of the invention it is best more fully described with reference to the accompanying drawings in which.

Figure 1:
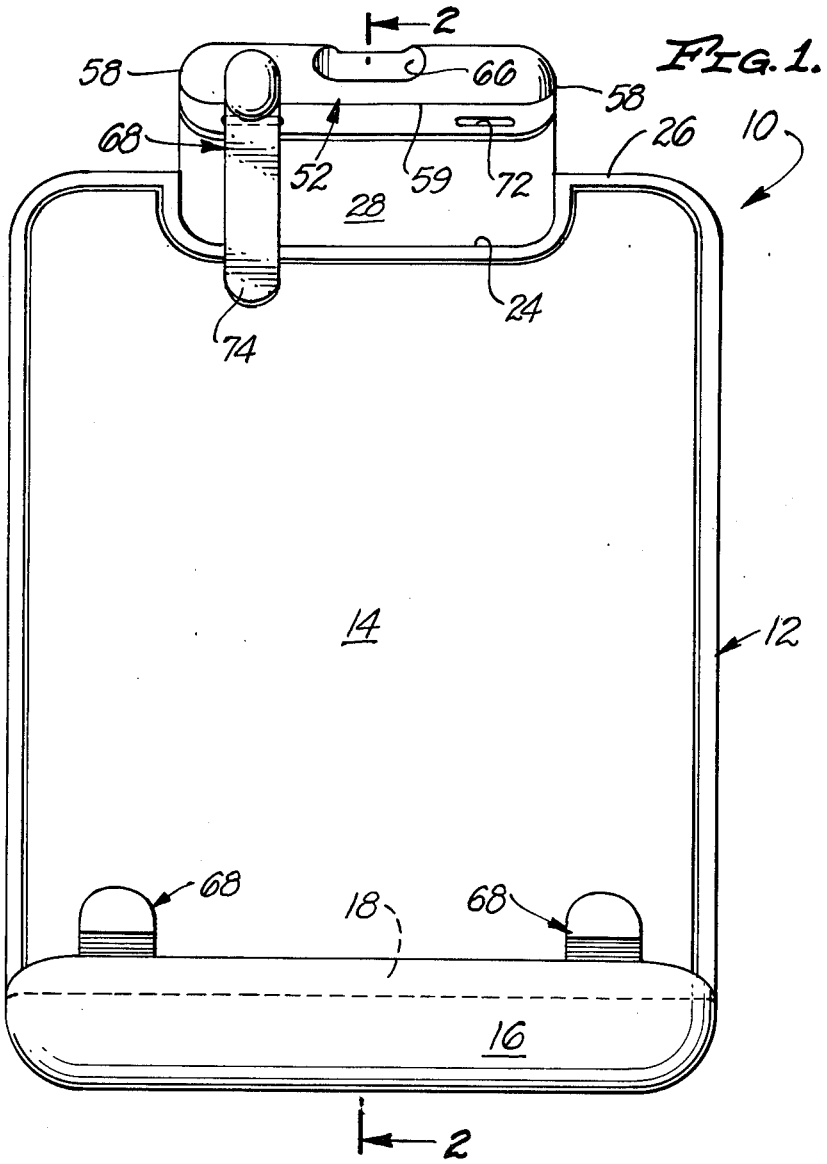
FIG. 1 is a front elevational view of a presently preferred embodiment or form of a copy holder in accordance with the invention.

The copy holder shown in the drawings and described in detail in this specification is constructed so as to utilize the operative concepts or principles of the present invention. The latter are set forth in detail in the accompanying claims forming a part of the disclosure of this specification. Those skill in the design and construction of various items of desk and similar equipment will realize that these concepts or principles can be easily used through the exercise or routine skill in the noted field in other differnetly appearing and/or differently constructed copy holders. For this reason the invention is to be considered as being limited only by the appended claims and is not to be considered as being limited by the accompanying drawings.

DETAILED DESCRIPTION OF THE PREFERRED EMBODIMENT

In the drawing there is shown a copy holder 10 in accordance with the present invention which is constructed so as to include a generally flap support member 12. This support member 12 includes a front surface 14 which is intended to be used in holding or supporting a document, book or other item (not shown) to be held by the copy holder 10. A hollow ledge or lip 16 having an upwardly facing shoulder 18 is located at the bottom 20 of this surface 14. Preferably two identical small slots 22 are located in the surface 14 so as to extend generally along and slightly above the shoulder 18 as shown.

Figures 2, 3, 4:
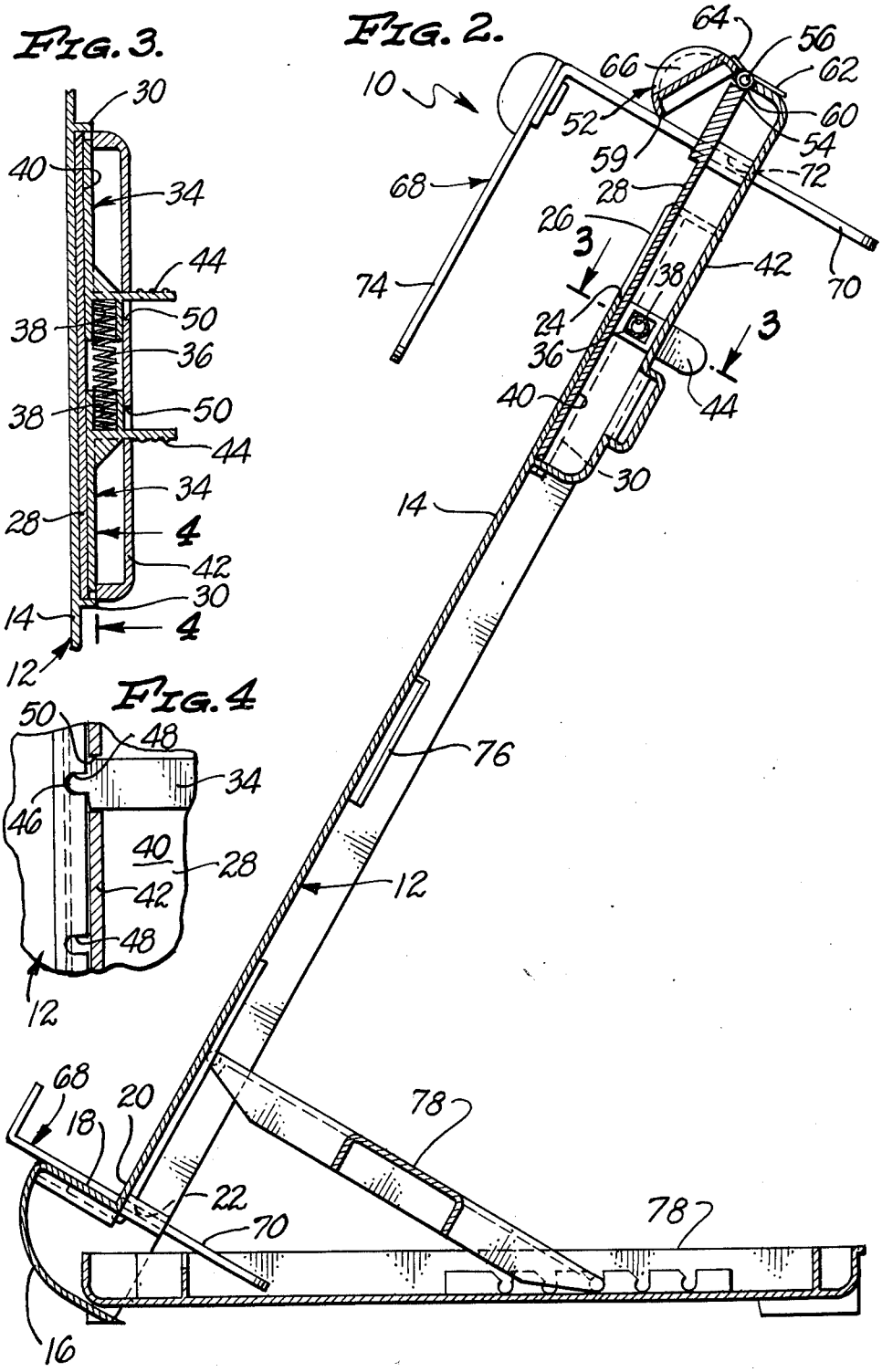
FIG. 2 is a cross-sectional view taken at line 2—2 of FIG. 1.
FIG. 3 is a partial cross-sectional view at an enlarged scale taken at line 3—3 of FIG. 2.
FIG. 4 is a partial cross sectional view taken at line 4—4 of FIG. 3.

A notch 24 is centrally located in the top 26 of the member 12 for the purpopse of accommodating a plate 28 in such a manner that this plate 28 is exposed at or along the front surface 14. This plate 28 is slidably located within parallel, overhanging guide lips 30 located on the rear 32 of the member 12 so as to extend perpedicular to the top 26. In effect these lips 30 act as rails which secure the plate 28 so that it can only be moved linearly. Normally the position of the plate 28 will be determined by means of latch members 34 as best seen in FIGS. 3 and 4 of the drawings.

The latch members 34 are normally biased apart by a single coil spring 36 which is located so as to extend into cavities 38 in these members 34. The members 34 fit flat against the back 40 of the plate 28 within a cover 42 extending over this back 40. Small projections or handles 44 are provided on the latch members 34 for the purpose of pulling them so as to compress the spring 36 in order to release small extensions or projections 46 from any of a series of notches 48 in the guide lips 30. These handles 44 extend outwardly through openings 50 in the cover 42 so that they can be digitally engaged.

A generally dome shaped elongated clamping member 52 us mounted along the top 54 of the plate 28 through the use of a conventional pivot shaft 56. This pivot shaft 56 extends between the ends 58 of this clamping member 52 in such a manner that the lower peripherial edge 59 of the clamping member 52 can rest against the plate 28. A conventional coil spring 60 is wound around the shaft 56 in such a manner than an end 62 of its bears against the plate 28 while the other end 65 of it engages the clamping member 52 so as to hold the clamping member 52 so that it is normally biased to a closed position in which the edge 59 is located against the plate 28.

If desired a notch 66 may be provided in the clamping member 52 so as to facilitate it being digitally engaged in opening it to allow the insertion of a paper or any other item (not shown) beneath it so that what ever is inserted is located against the surface 14. In the event that such an item is comparatively thick it can be accommodated by the use of one or two holdfasts 68 such as the hold-down 68 illustrated at the tops of FIGS. 1 and 2. Each of the holdfasts 68 illustrated has a flat, tab like leg 70 which is adapted to slip within either of two correspondingly shaped slots 72 located within the plate 28. These slots 72 are flat, horizontally extending slots serving much as bearing so as to permit movement of a leg 70 within them when it is desired or necessary to use a hold-downs 68. They are sufficiently long so as to minimize cocking of the holdfasts 68.

It is noted that in order to use a holdfast 68 that it is necessary to pivot the clamping member 52 form its normal position so as to uncover the slots 72. At this point it is possible to insert a holdfast 68 within one of the slots 72. Then the holdfast 68 which has been inserted can be clamped against movement by releasing the clamping member 52. As a result of the action of the spring 60 the edge 59 will then engage the leg 70 of the holdfast 68 so as to secure the holdfast 68 in the position in which it was located when the clamping member 54 was released. This will secure the head 74 on any holdfast 68 so engaged in a fixed position.

At times the height of a book will be such that the book cannot be inserted between a top holdfast 68 and the shoulder 18 because the book is slightly to tall to fit within this space. In such cases it is possible to increase the distance between the holdfast 68 used and the shoulder 18 by manipulating the latch members 34 and the plate 28 so that different of the notches 48 are engaged. This same procedure can be used when it is desirable to use a size paper which cannot be accommodated when the plate is in its lower most position. This can be desirable in using a copy holder 10 which is primarily intended for use with US letter size paper with A-4 sized paper.

The use of two of the slots 72 as illustrated is considered desirable since it enables the copy holder 10 to be used with comparatively thick books (not shown) even when such books are opened in such a manner that the number of pages on each side of the page to which the book is opened differ significantly. When the copy holder 10 is to be used with such a thick book it is considered that it is at least highly desirable to use two of the holdfasts 68 so that the head 74 on one holdfast 68 engages one page to which such a book is opened and the head 74 on the other holdfast 68 engages the other exposed page.

At times the shoulder 18 may not be sufficiently large to adequately support such a comparatively thick book. If this should prove to be the case the bottom of such a book can be accommodated by the use of one or two other holdfasts 68 in the slots 22 as shown. The holdfasts 68 used in such slots 22 so not normally need to be clamped in place in order to serve their function while those holdfast 68 used in connection with the slots 56 need to be clamped as previously described in order to achieve an adequate holding action. This is because the holdfasts 68 used in the slots 22 rest against the shoulder 18 as a result of the weight of any book held open as described. This will normally create enough friction to achieve an adequate holding action at the bottom of such a book.

In order to complete the copy holder 10 it is normally necessary to incorporate within it means for holding it in a desired position such that copy (not shown) located on the surface 14 can be casually inspected. If desired such means can take the form of a known clip like structure 75 which is adapted to be slipped over an end (not shown) of a supporting arm structure (not shown). If desired known, connected leg brackets 78 may be secured to the support member 12 in a conventional manner. Because such expedients are well known they are not described in detail herein.

We claim:

1. A copy holder having a vertically oriented support member containing a front surface which is adapted to hold an item so that it can be visually inspected and having a clamping member which is movable relative to the top of said surface so as to engage such an item so as to hold an item against movement in which the improvement comprises:

said support member including an opening extending there through, said opening being located adjacent to and beneath said clamping member, a holdfast having an elongated leg and a head, said leg being shaped so that said leg can be inserted within and moved within said opening so that said head is spaced at various distances from said surface, said clamping member and said holdfast being shaped and located so that said clamping member engages said holdfast when said leg is inserted within said opening so as to secure said holdfast against movement, said support member includes plate means mounted on the remainder of said support member so as to be capable of being moved in a vertical direction and latch means for positioning said plate in a desired position, and said clamping member is located on said plate means.

2. A copy holder as claimed in claim 1 wherein:

said opening is a flat slot and said leg is a flat leg fitting closely within said slot, said slot acting as a bearing permitting linear movement of said leg relative to said support member.

3. A copy holder as claimed in claim 1 wherein:

there are two of said openings and two of said holdfasts, said openings and said holdfasts being located so that the pages of a book can be held open by one of said holdfasts engaging one page of a book while the other holdfast engages the opposite page of the book.

4.

A copy holder having a vertically oriented support member containing a front surface which is adapted to hold an item so that it can be visually inspected and having a clamping member which is movable relative to the top of said surface so as to engage such an item so as to hold an item against movement in which the improvement comprises:

said support member including an opening extending there through, said opening being located adjacent to and beneath said clamping member, a holdfast having an elongated leg and a head, said leg being shaped so that said leg can be inserted within and moved within said opening so that said head is spaced at various distances from said surface, said clamping member and said holdfast being shaped and located so that said clamping member engages said holdfast when said leg is inserted within said openign so as to secure said holdfast against movement, said support member includes plate means mounted on the remainder of said support member so as to be capable of being moved in a vertical direction and latch means for positioning said plate means in a desired position, said clamping member is located on said plate means.

said opening is a flat slot and said leg is a flat leg fitting closely within said slot, said slot acting as a bearing permitting linear movement of said leg relative to said support member, there are two of said openings and two of said holdfasts, said openings and said holdfasts being located so that the pages of a book can be held open by one of said holdfasts engaging one page of a book while the other holdfast engages the opposite page of the book, said support member includes a ledge adjacent to the bottom of the front surface thereof and another opening extending through said support member adjacent said ledge, there is another of said holdfasts located so that its leg extends through said opening adjacent to said ledge, said opening is a flat slot and said leg is a flat leg fitting closely within said slot, said slot acting as a bearing permitting linear movement of said leg relative to said support member, and there are two of said other openings and two of said other holdfasts, said other openings and said other holdfasts being located so that the pages of a book can be held open by one of said other holdfasts engaging one page of a book while the other of said other holdfasts engages the opposite page of the book.

* * * * *